US011705265B2

(12) United States Patent
Asai et al.

(10) Patent No.: US 11,705,265 B2
(45) **Date of Patent: *Jul. 18, 2023**

(54) COIL COMPONENT

(71) Applicant: TDK CORPORATION, Tokyo (JP)

(72) Inventors: Miyuki Asai, Tokyo (JP); Takahiro Kawahara, Tokyo (JP); Masazumi Arata, Tokyo (JP); Hitoshi Ohkubo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 389 days.

This patent is subject to a terminal disclaimer.

(21) Appl. No.: 16/877,898

(22) Filed: May 19, 2020

(65) Prior Publication Data

US 2020/0373061 A1 Nov. 26, 2020

(30) Foreign Application Priority Data

May 21, 2019 (JP) ..... 2019-095128

(51) Int. Cl.
*H01F 5/06* (2006.01)
*H01F 27/255* (2006.01)

(52) U.S. Cl.
CPC ..... *H01F 27/255* (2013.01); *H01F 5/06* (2013.01)

(58) Field of Classification Search
None
See application file for complete search history.

(56) References Cited

U.S. PATENT DOCUMENTS

| | | | | |
|---|---|---|---|---|
| 9,704,640 | B2 * | 7/2017 | Choi | H01F 17/04 |
| 10,930,420 | B2 * | 2/2021 | Hachiya | H01F 1/24 |
| 10,943,719 | B2 * | 3/2021 | Asai | H01F 17/0013 |
| 11,569,024 | B2 * | 1/2023 | Onuma | H01F 27/323 |
| 2016/0086716 | A1 * | 3/2016 | Choi | H01F 17/0013 427/127 |
| 2016/0247624 | A1 | 8/2016 | Seo et al. | |
| 2018/0033533 | A1 | 2/2018 | Ryu et al. | |
| 2020/0373064 | A1 * | 11/2020 | Asai | H01F 27/324 |
| 2020/0373077 | A1 * | 11/2020 | Onuma | H01F 27/2871 |
| 2022/0139606 | A1 * | 5/2022 | Lee | H01F 27/323 336/192 |

FOREIGN PATENT DOCUMENTS

JP 2018-019062 A 2/2018

* cited by examiner

*Primary Examiner* — Jermele M Hollington
(74) *Attorney, Agent, or Firm* — Oliff PLC

(57) ABSTRACT

In a coil component, a second magnetic portion disposed in the vicinity of a coil is designed to have a higher proportion of Fe than a metal magnetic powder-containing resin constituting a first magnetic portion. Therefore, a magnetic flux of the coil flows smoothly. Although the second magnetic portion has a relatively lower withstand voltage than the first magnetic portion, since the second magnetic portion is surrounded by the first magnetic portion, it is not exposed on an outer surface of a magnetic body. For this reason, a situation in which the coil and external terminal electrodes are short-circuited with the second magnetic portion therebetween is effectively curbed, and short-circuiting between the coil and the external terminal electrodes can be curbed.

6 Claims, 4 Drawing Sheets

COIL COMPONENT

CROSS-REFERENCE TO RELATED APPLICATIONS

This application is based upon and claims the benefit of priority from Japanese Patent Application No. 2019-95128, filed on 21 May 2019, the entire contents of which are incorporated herein by reference.

TECHNICAL FIELD

The present disclosure relates to a coil component.

BACKGROUND

Regarding a coil component in the related art, for example, Japanese Unexamined Patent Publication No. 2018-19062 discloses a coil component including a coil, a magnetic body that covers the coil, and an external electrode that is provided on a side surface of the magnetic body and is electrically connected to a coil portion. The coil portion in this literature has a configuration provided with a coil pattern which is subjected to insulation coating on each of both surfaces of an insulation substrate. In addition, the magnetic body in this literature is configured to have a first magnetic body which is constituted of a metal magnetic powder-containing resin having a relatively high magnetic flux density and is positioned in the vicinity of the coil, and a second magnetic body which is constituted of a metal magnetic powder-containing resin having a relatively low magnetic flux density and is positioned farther away from the coil than the first magnetic body, thereby alleviating saturation of a magnetic flux generated around the coil.

SUMMARY

In a coil component according to the technology in the related art described above, it is assumed that a proportion of a metal magnetic powder in a metal magnetic powder-containing resin constituting a first magnetic body is higher than a proportion of a metal magnetic powder in a metal magnetic powder-containing resin constituting a second magnetic body, so that a first magnetic portion has a comparatively low withstand voltage. For this reason, there may be a situation in which a short circuit occurs in the first magnetic body at a place interposed between the coil and the external electrode.

According to the present disclosure, a coil component having an improved withstand voltage is provided.

According to an aspect of the present disclosure, there is provided a coil component including an insulation substrate provided with a penetration hole, a coil having a first coil portion subjected to insulation coating with a first flat coil pattern formed around the penetration hole on one surface of the insulation substrate, a magnetic body integrally covering the insulation substrate and the coil, and a pair of external terminal electrodes provided on an outer surface of the magnetic body and being respectively connected to end portions of the coil. The magnetic body has a first magnetic portion constituted of a metal magnetic powder-containing resin containing metal magnetic powders including Fe and constitutes the outer surface of the magnetic body, and a second magnetic portion surrounded by the first magnetic portion, the second magnetic portion covering at least a part of the coil, and having a higher compositional proportion of Fe than the metal magnetic powder-containing resin constituting the first magnetic portion.

In the coil component, the second magnetic portion having a relatively lower withstand voltage than the first magnetic portion is surrounded by the first magnetic portion. For this reason, the second magnetic portion is not exposed on the outer surface of the magnetic body, so that the external terminal electrodes provided on the outer surface of the magnetic body and the second magnetic portion do not come into contact with each other. Therefore, a situation in which the coil and the external terminal electrodes are short-circuited with the second magnetic portion therebetween is effectively curbed, and short-circuiting between the coil and the external terminal electrodes can be curbed.

In the coil component according to the aspect of the present disclosure, the coil may have a second coil portion subjected to insulation coating with a second flat coil pattern formed around the penetration hole on the other surface of the insulation substrate.

In the coil component according to the aspect of the present disclosure, the second magnetic portion may be present in the whole region of an inward region of the coil.

In the coil component according to the aspect of the present disclosure, a smallest thickness in a thickness of the first magnetic portion, the smallest thickness is a distance from the outer surface of the magnetic body to the second magnetic portion, may be longer than a length of a largest particle of the metal magnetic powders included in the metal magnetic powder-containing resin constituting the first magnetic portion.

In the coil component according to the aspect of the present disclosure, the magnetic body may have a pair of main surfaces facing each other in a thickness direction of the insulation substrate and a pair of end surfaces facing each other in a direction orthogonal to the thickness direction of the insulation substrate, and provided with the pair of external terminal electrodes respectively. A main surface-side thickness of the first magnetic portion which is a distance from the main surface of the magnetic body to the second magnetic portion may be shorter than an end surface-side thickness of the first magnetic portion which is a distance from the end surface of the magnetic body to the second magnetic portion.

In the coil component according to the aspect of the present disclosure, the second magnetic portion may be constituted of a metal magnetic powder-containing resin containing metal magnetic powders including Fe.

The coil component according to the aspect of the present disclosure may further include an insulation coating layer covering an outer surface of the second magnetic portion.

DETAILED DESCRIPTION

Figure 1:
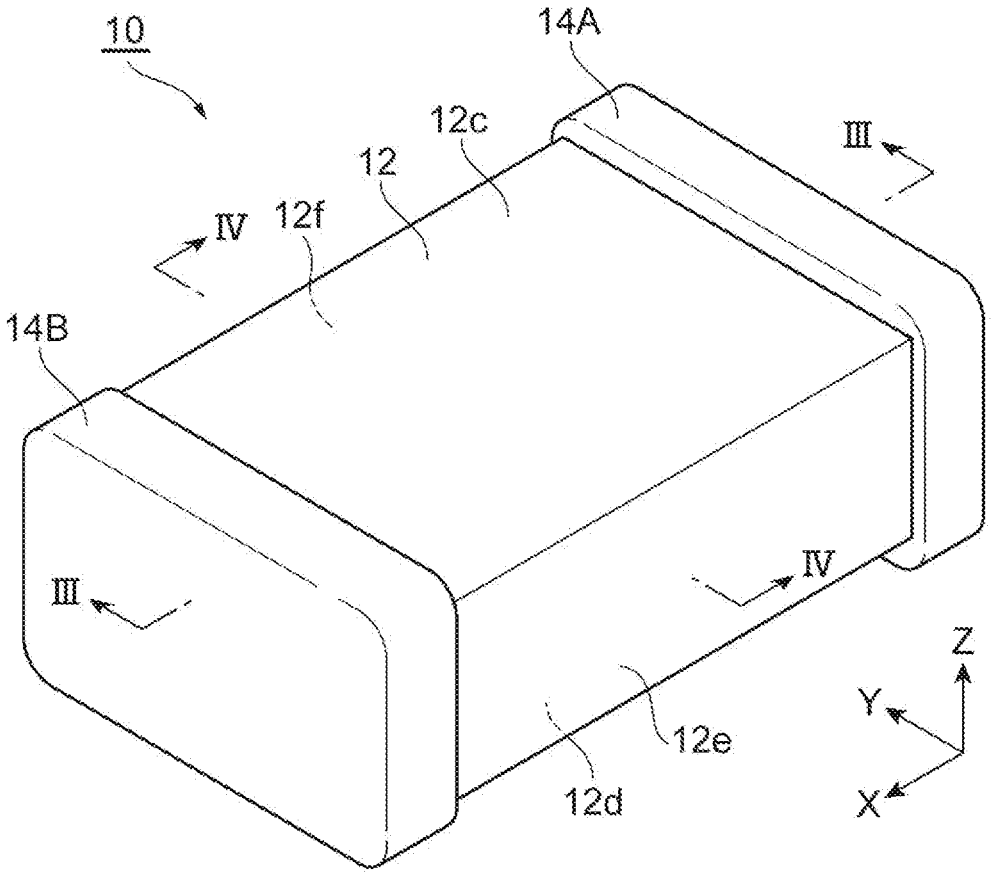
FIG. 1 is a schematic perspective view of a coil component according to an embodiment.

Hereinafter, with reference to the accompanying drawings, an embodiment of the present disclosure will be described in detail. In the description, the same reference signs are used for the same elements or elements having the same function, and duplicate description will be omitted.

With reference to FIGS. 1 to 4, a structure of a coil component according to the embodiment will be described. For the sake of convenience of description, an XYZ coordinate system is set as shown in the diagrams. That is, a thickness direction of the coil component is set to a Z direction, a direction in which external terminal electrodes face each other is set to an X direction, and a direction orthogonal to the Z direction and the X direction is set to a Y direction.

A coil component 10 is a flat coil element, which is constituted of a main body portion 12 which exhibits a rectangular parallelepiped shape, and a pair of external terminal electrodes 14A and 14B which are provided on an outer surface of the main body portion 12. The main body portion 12 has a pair of end surfaces 12*a* and 12*b* which face each other in the X direction, a pair of main surfaces 12*c* and 12*d* which face each other in the Z direction, and a pair of side surfaces 12*e* and 12*f* which face each other in the Y direction. The pair of external terminal electrodes 14A and 14B are provided such that the whole surfaces of the pair of end surfaces 12*a* and 12*b* are covered. As an example, the coil component 10 is designed to have dimensions of a long side of 2.5 mm, a short side of 2.0 mm, and a height within a range of 0.8 to 1.0 mm The main body portion 12 is configured to include an insulation substrate 20, a coil C provided in the insulation substrate 20, and a magnetic body 26.

The insulation substrate 20 is a plate-shaped member constituted of a non-magnetic insulating material and has a substantially elliptical ring shape when viewed in the thickness direction thereof. An elliptical penetration hole 20*c* is provided in a central part of the insulation substrate 20. A substrate in which a glass cloth is impregnated with an epoxy-based resin and which has a plate thickness within a range of 10 μm to 60 μm can be used as the insulation substrate 20. Not only an epoxy-based resin but also a BT resin, polyimide, aramid, or the like can be used. Regarding a material for the insulation substrate 20, ceramic or glass can also be used. Regarding a material for the insulation substrate 20, a material for mass-produced printed boards may be adopted. Also, a resin material used for BT printed boards, FR4 printed boards, or FR5 printed boards may be adopted.

The coil C has a first coil portion 22A which is subjected to insulation coating with a first conductor pattern 23A for a flat air-core coil provided on one surface 20*a* (upper surface in FIG. 2) of the insulation substrate 20, a second coil portion 22B which is subjected to insulation coating with a second conductor pattern 23B for a flat air-core coil provided on the other surface 20*b* (lower surface in FIG. 2) of the insulation substrate 20, and a through-hole conductor 25 which connects the first conductor pattern 23A and the second conductor pattern 23B to each other.

Figure 2:
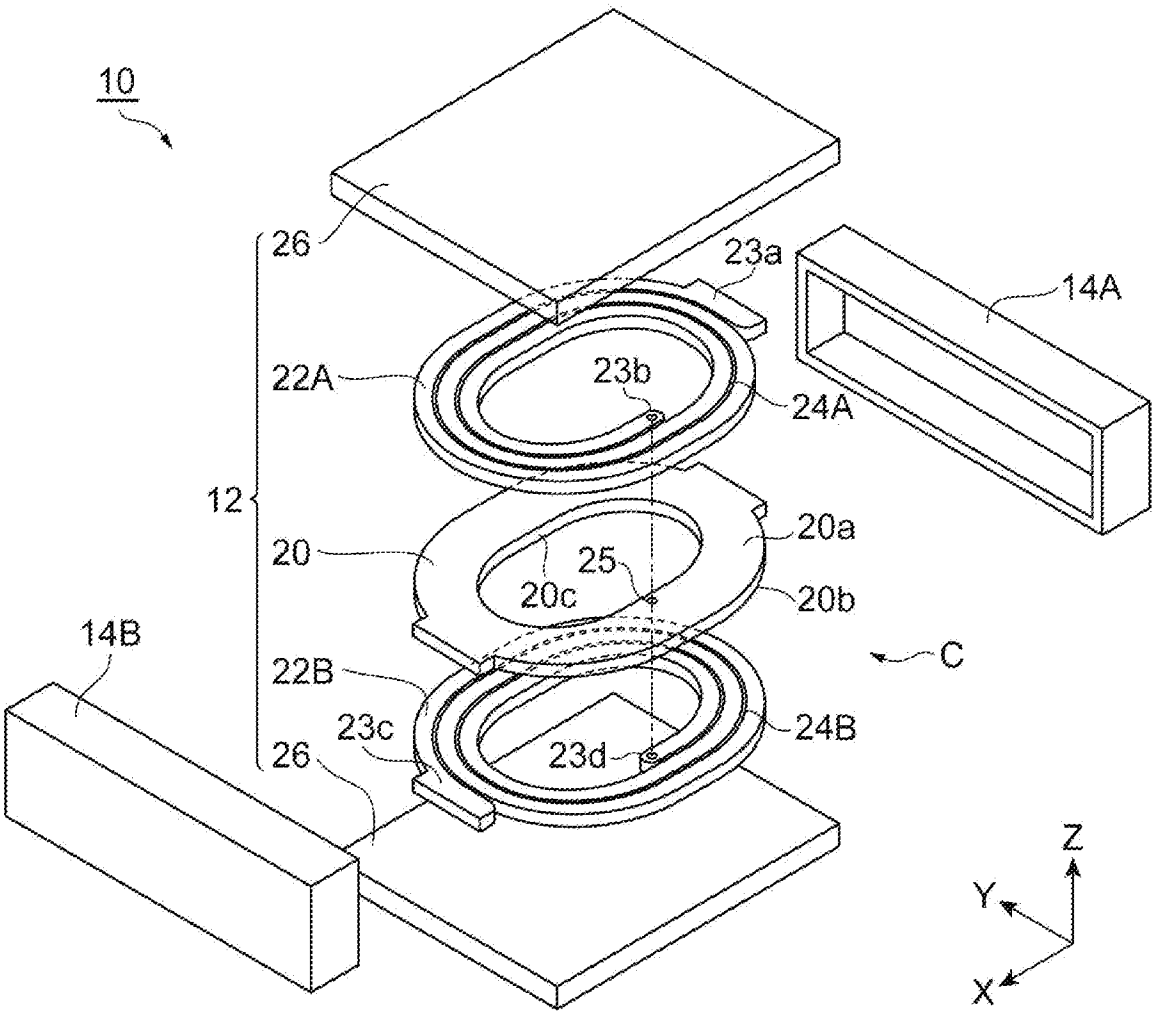
FIG. 2 is an exploded view of the coil component shown in FIG. 1.

The first conductor pattern 23A (first flat coil pattern) is a flat spiral pattern serving as a flat air-core coil and is formed through plating using a conductor material such as Cu. The first conductor pattern 23A is formed to be wound around the penetration hole 20*c* of the insulation substrate 20. More specifically, as shown in FIG. 2, the first conductor pattern 23A is wound in three clockwise turns toward the outward side when viewed in the upward direction (Z direction). The height of the first conductor pattern 23A (length in the thickness direction of the insulation substrate 20) is the same throughout the entire length.

An end portion 23*a* of the first conductor pattern 23A on the outward side is exposed on the end surface 12*a* of the main body portion 12 and is connected to the external terminal electrode 14A covering the end surface 12*a*. An end portion 23*b* of the first conductor pattern 23A on the inward side is connected to the through-hole conductor 25.

Similar to the first conductor pattern 23A, the second conductor pattern 23B (second flat coil pattern) is also a flat spiral pattern serving as a flat air-core coil and is formed through plating using a conductor material such as Cu. The second conductor pattern 23B is also formed to be wound around the penetration hole 20*c* of the insulation substrate 20. More specifically, the second conductor pattern 23B is wound in three counterclockwise turns toward the outward side when viewed in the upward direction (Z direction). That is, the second conductor pattern 23B is wound in a direction opposite to that of the first conductor pattern 23A when viewed in the upward direction. The height of the second conductor pattern 23B is the same throughout the entire length and can be designed to have the same height as that of the first conductor pattern 23A.

An end portion 23*c* of the second conductor pattern 23B on the outward side is exposed on the end surface 12*b* of the main body portion 12 and is connected to the external terminal electrode 14B covering the end surface 12*b*. An end portion 23*d* of the second conductor pattern 23B on the inward side is positionally aligned with the end portion 23*b* of the first conductor pattern 23A on the inward side in the thickness direction of the insulation substrate 20 and is connected to the through-hole conductor 25.

The through-hole conductor 25 is provided such that it penetrates an edge region of the penetration hole 20*c* of the insulation substrate 20 and connects the end portion 23*b* of the first conductor pattern 23A and the end portion 23*d* of the second conductor pattern 23B to each other. The through-hole conductor 25 can be constituted of a hole provided in the insulation substrate 20 and a conductive material (for example, a metal material such as Cu) filling the hole. The through-hole conductor 25 has a substantially columnar or a substantially prismatic external shape extending in the thickness direction of the insulation substrate 20.

Figure 3:
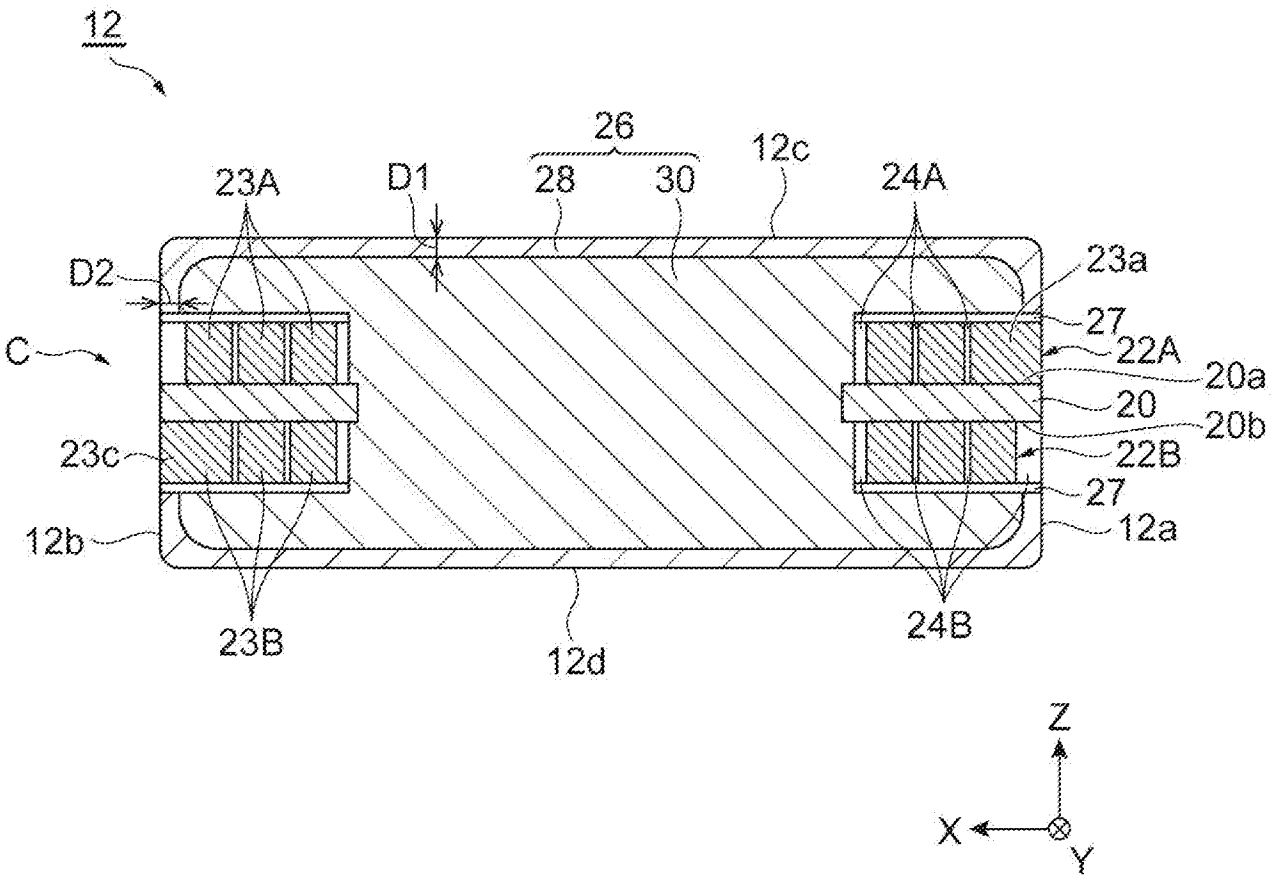
FIG. 3 is a cross-sectional view along line III-III in the coil component shown in FIG. 1.
Figure 4:
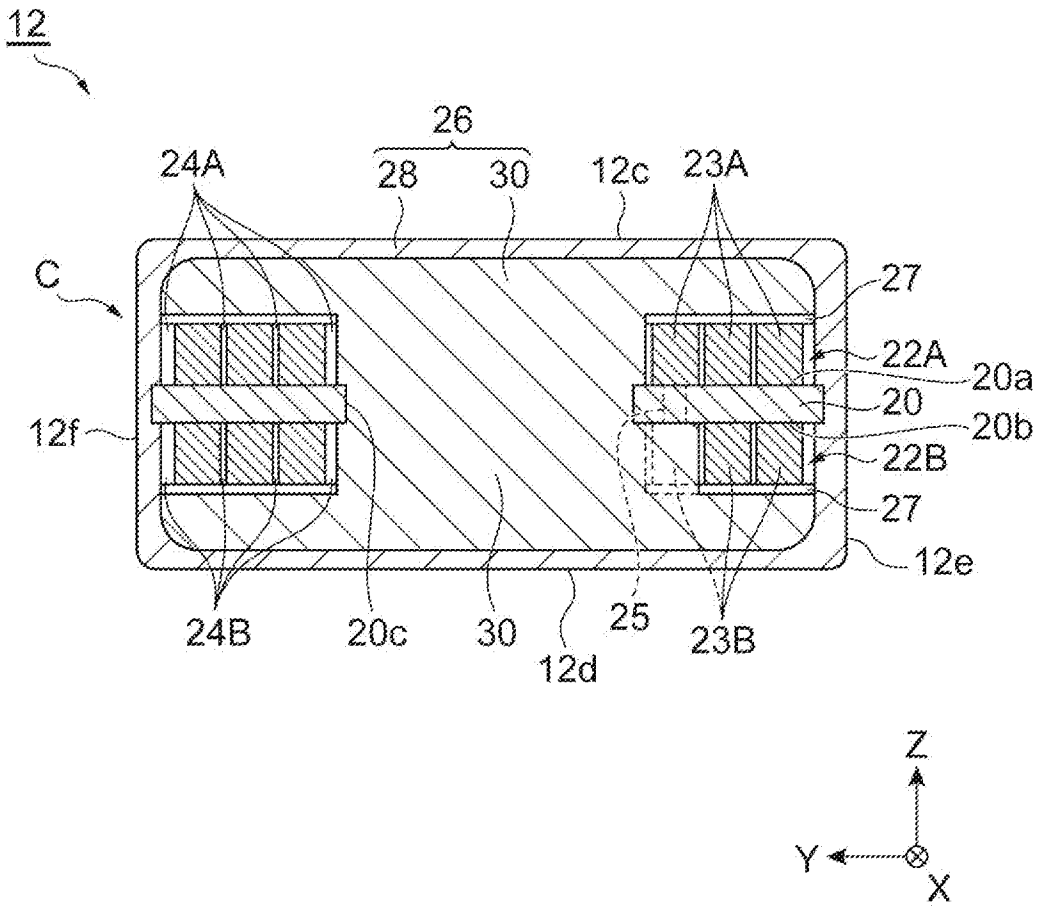
FIG. 4 is a cross-sectional view along line IV-IV in the coil component shown in FIG. 1.

In addition, as shown in FIGS. 3 and 4, the first coil portion 22A and the second coil portion 22B have resin walls 24A and 24B, respectively. The resin wall 24A of the first coil portion 22A is positioned between lines and on the inner circumference and the outer circumference of the first conductor pattern 23A. Similarly, the resin wall 24B of the second coil portion 22B is positioned between lines and on the inner circumference and the outer circumference of the second conductor pattern 23B. In the present embodiment, the resin walls 24A and 24B positioned on the inner circumferences and the outer circumferences of the conductor patterns 23A and 23B are designed to be thicker than the resin walls 24A and 24B positioned between lines of the conductor patterns 23A and 23B.

The resin walls 24A and 24B are constituted of an insulating resin material. The resin walls 24A and 24B can be provided on the insulation substrate 20 before the first conductor pattern 23A and the second conductor pattern 23B are formed. In this case, the first conductor pattern 23A and the second conductor pattern 23B are subjected to plating growth between walls defined by the resin walls 24A and 24B. The resin walls 24A and 24B can be provided on the insulation substrate 20 after the first conductor pattern 23A and the second conductor pattern 23B are formed. In this case, the resin walls 24A and 24B are provided in the first conductor pattern 23A and the second conductor pattern 23B through filling, painting, or the like.

The first coil portion 22A and the second coil portion 22B respectively have insulation layers 27 which integrally cover the first conductor pattern 23A, the second conductor pattern 23B, and the resin walls 24A and 24B from the upper surface side. The insulation layer 27 can be constituted of an insulating resin or an insulating magnetic material. The insulation layers 27 are interposed between the conductor pattern 23A of the first coil portion 22A and the conductor pattern 23B of the second coil portion 22B, and a first magnetic portion 28 of the magnetic body 26, thereby enhancing insulating properties between the conductor patterns 23A and 23B and the metal magnetic powders included in the first magnetic portion 28.

The magnetic body 26 integrally covers the insulation substrate 20 and the coil C. More specifically, the magnetic body 26 covers the insulation substrate 20 and the coil C in an up-down direction and covers the outer circumference of the insulation substrate 20 and the coil C. In addition, the magnetic body 26 fills the inside of the penetration hole 20*c* of the insulation substrate 20 and an inward region of the coil C.

As shown in FIGS. 3 and 4, the magnetic body 26 is configured to include the first magnetic portion 28 and a second magnetic portion 30.

The first magnetic portion 28 constitutes all the outer surfaces of the magnetic body 26, that is, the end surfaces 12*a* and 12*b*, the main surfaces 12*c* and 12*d*, and the side surfaces 12*e* and 12*f*.

The first magnetic portion 28 is constituted of a metal magnetic powder-containing resin. The metal magnetic powder-containing resin is a binding powdery substance in which a metal magnetic powdery substance is bound with a binder resin. The metal magnetic powders of the metal magnetic powder-containing resin constituting the first magnetic portion 28 are configured to include magnetic powders (for example, an iron-nickel alloy (permalloy alloy), carbonyl iron, amorphous, a non-crystalline or crystalline FeSiCr-based alloy, or Sendust) including at least Fe. For example, the binder resin is a thermosetting epoxy resin. In the present embodiment, a metal magnetic powdery substance content in the binding powdery substance is within a range of 80 to 92 vol % in percent by volume and is within a range of 95 to 99 wt % in percent by mass. From the viewpoint of magnetic characteristics, the metal magnetic powdery substance content in the binding powdery substance may be within a range of 85 to 92 vol % in percent by volume and may be within a range of 97 to 99 wt % in percent by mass. The magnetic powders of the metal magnetic powder-containing resin constituting the first magnetic portion 28 may be a powdery substance having an average particle size of one kind or may be a powder mix having an average particle size of a plurality of kinds. When the metal magnetic powders of the metal magnetic powder-containing resin constituting the first magnetic portion 28 are in a powder mix, the kinds or the Fe compositional proportions of the magnetic powders having different average particle sizes may be the same or may vary. As an example, in a case of a powder mix having average particle sizes of three kinds, the particle size of magnetic powders (large particle powders) having the largest average particle size can be within a range of 15 to 30 μm, the particle size of magnetic powders (small particle powders) having the smallest average particle size can be within a range of 0.3 to 1.5 μm, and magnetic powders (intermediate powders) having an average particle size between those of the large particle powders and the small particle powders can be within a range of 3 to 10 μm. 100 parts by weight of a powder mix may include large particle powders within a range of 60 to 80 parts by weight, intermediate particle powders within a range of 10 to 20 parts by weight, and small particle powders within a range of 10 to 20 parts by weight.

The average particle size of magnetic powders is stipulated by the particle size (d50, a so-called median size) at 50% of the integrated value in a particle size distribution and is obtained as follows. A scanning electron microscope (SEM) photograph of a cross section of the first magnetic portion 28 is captured. The captured SEM photograph is subjected to image processing using software, boundaries of magnetic powders are distinguished, and the area of the magnetic powders is calculated. The particle size is calculated by converting the calculated area of the magnetic powders into an equivalent circle diameter. For example, the particle sizes of 100 or more magnetic powders are calculated, and a particle size distribution of these magnetic powders is obtained. The particle size at 50% of the integrated value in the obtained particle size distribution is referred to as the average particle size d50. The particle shapes of the magnetic powders are not particularly limited.

The second magnetic portion 30 directly covers at least a part of the first coil portion 22A provided on the one surface 20*a* of the insulation substrate and at least a part of the second coil portion 22B provided on the other surface 20*b*. The second magnetic portion 30 may have a form covering the whole part of the first coil portion 22A and the whole part of the second coil portion 22B. In the present embodiment, the second magnetic portion 30 fills the inside of the penetration hole 20*c* of the insulation substrate 20 and fills the inward region of the coil C. The second magnetic portion 30 is surrounded by the first magnetic portion 28 and is not exposed on the outer surface of the magnetic body 26.

The second magnetic portion 30 is constituted of a metal magnetic powder-containing resin. For example, a thermosetting epoxy resin can be used as a resin for a metal magnetic powder-containing resin constituting the second magnetic portion 30. The metal magnetic powders of the metal magnetic powder-containing resin constituting the second magnetic portion 30 are configured to include magnetic powders (for example, an iron-nickel alloy (permalloy alloy), carbonyl iron, amorphous, a non-crystalline or crystalline FeSiCr-based alloy, or Sendust) including at least Fe. The metal magnetic powders of the metal magnetic powder-containing resin constituting the second magnetic portion 30 may be a powdery substance having an average particle size of one kind or may be a powder mix having an average particle size of a plurality of kinds. When the metal magnetic powders of the metal magnetic powder-containing resin constituting the second magnetic portion 30 are in a powder mix, the kinds or the Fe compositional proportions of the magnetic powders having different average particle sizes may be the same or may vary. As an example, in a case of a powder mix having average particle sizes of three kinds, the particle size of magnetic powders (large particle powders) having the largest average particle size can be within a range of 15 to 30 μm, the particle size of magnetic powders (small particle powders) having the smallest average particle size can be within a range of 0.3 to 1.5 μm, and magnetic powders (intermediate powders) having an average particle size between those of the large particle powders and the small particle powders can be within a range of 3 to 10 μm. 100 parts by weight of a powder mix may include large particle powders within a range of 60 to 80 parts by weight, intermediate particle powders within a range of 10 to 20 parts by weight, and small particle powders within a range of 10 to 20 parts by weight.

The average particle size of magnetic powders is stipulated by the particle size (d50, a so-called median size) at 50% of the integrated value in a particle size distribution and is obtained as follows. An SEM photograph of a cross section of the second magnetic portion 30 is captured. The captured SEM photograph is subjected to image processing using software, boundaries of magnetic powders are distinguished, and the area of the magnetic powders is calculated. The particle size is calculated by converting the calculated area of the magnetic powders into an equivalent circle diameter. For example, the particle sizes of 100 or more magnetic powders are calculated, and a particle size distribution of these magnetic powders is obtained. The particle size at 50% of the integrated value in the obtained particle size distribution is referred to as the average particle size d50. The particle shapes of the magnetic powders are not particularly limited.

A metal magnetic powder-containing resin constituting the second magnetic portion 30 is designed to have a higher proportion (compositional proportion) of Fe than the metal magnetic powder-containing resin constituting the first magnetic portion 28. For this reason, a withstand voltage of the second magnetic portion 30 is lower than a withstand voltage of the first magnetic portion 28. In addition, the metal magnetic powder-containing resin constituting the second magnetic portion 30 has a higher saturation magnetic flux density (Bs) than the metal magnetic powder-containing resin constituting the first magnetic portion 28. For example, the saturation magnetic flux density of the second magnetic portion 30 may be as high as 1.5 times to 20 times the saturation magnetic flux density of the first magnetic portion 28. In this manner, since a second magnetic portion having a high saturation magnetic flux density is provided in the vicinity of the coil C, the magnetic flux of the coil C flows smoothly.

For example, the second magnetic portion 30 can be formed by a printing method or a dispenser method. That is, the second magnetic portion 30 can be formed by applying a kneaded paste of metal magnetic powders (material of the metal magnetic powder-containing resin) and a resin to a region, in which the second magnetic portion 30 is to be formed, through a printing method or a dispenser method, and curing the paste thereafter.

In the coil component 10, since the second magnetic portion 30 disposed in the vicinity of the coil C is designed to have a higher proportion of Fe than the metal magnetic powder-containing resin constituting the first magnetic portion 28, the magnetic flux of the coil C flows smoothly. Although the second magnetic portion 30 has a relatively lower withstand voltage than the first magnetic portion 28, since the second magnetic portion 30 is surrounded by the first magnetic portion, it is not exposed on the outer surface of the magnetic body 26. That is, the second magnetic portion 30 does not come into direct contact with the external terminal electrodes 14A and 14B provided on the outer surface of the magnetic body 26 but is adjacent thereto with the first magnetic portion 28 having a relatively high withstand voltage therebetween. Therefore, a situation in which the coil C and the external terminal electrodes 14A and 14B are short-circuited with the second magnetic portion 30 therebetween is effectively curbed, and short-circuiting between the coil C and the external terminal electrodes 14A and 14B can be curbed.

In addition, in the coil component 10 described above, since the second magnetic portion 30 having a high saturation magnetic flux density is present in the whole region of the inward region of the coil C, the magnetic flux along the coil axis of the coil C flows smoothly.

Moreover, in the coil component 10, the first magnetic portion 28 is designed to have a smallest thickness regarding the thickness (that is, the distance from the outer surface of the magnetic body 26 to the second magnetic portion 30) longer than the length of a largest particle of the metal magnetic powders included in the metal magnetic powder-containing resin constituting the first magnetic portion 28. For example, the length of the largest particle is within a range of 50 to 300 μm. The largest particle can be determined by performing image processing on a photograph of a cross section of the first magnetic portion 28 using software and distinguishing boundaries of the magnetic powders. For example, the longest magnetic particle can be determined as the largest particle after measuring the lengths of approximately 100 magnetic powders. The particle shapes of the magnetic powders are not particularly limited. For this reason, a situation in which the outside of the magnetic body 26 and the second magnetic portion 30 are conducted via large magnetic powders included in the first magnetic portion 28 is effectively curbed.

In addition, in the coil component 10, a main surface-side thickness D1 of the first magnetic portion 28 which is the distance from the main surface 12*c* or 12*d* of the magnetic body 26 to the second magnetic portion 30 is designed to be shorter than an end surface-side thickness D2 of the first magnetic portion 28 which is the distance from the end surface 12*a* or 12*b* of the magnetic body 26 to the second magnetic portion 30. For example, the main surface-side thickness D1 is within a range of 50 to 300 μm, and for example, the end surface-side thickness D2 is within a range of 60 to 400 μm. In this case, on a side of the end surfaces 12*a* and 12*b* of the magnetic body 26, sufficient separation distances between the second magnetic portion 30 and the external terminal electrodes 14A and 14B are ensured, and a situation in which the second magnetic portion 30 and the external terminal electrodes 14A and 14B are short-circuited can be curbed.

The present disclosure is not limited to the embodiment described above, and various forms can be adopted. For example, the coil C may adopt a form including both a first coil portion and a second coil portion or may adopt a form including only a first coil portion.

What is claimed is:

1. A coil component comprising:

an insulation substrate provided with a penetration hole;

a coil having a first coil portion subjected to insulation coating with a first flat coil pattern formed around the penetration hole on one surface of the insulation substrate;

a magnetic body integrally covering the insulation substrate and the coil; and a pair of external terminal electrodes provided on an outer surface of the magnetic body and being respectively connected to end portions of the coil, wherein the magnetic body has a first magnetic portion constituted of a metal magnetic powder-containing resin containing metal magnetic powders including Fe and constitutes the outer surface of the magnetic body, and a second magnetic portion surrounded by the first magnetic portion, the second magnetic portion covering at least a part of the coil, and having a higher compositional proportion of Fe than the metal magnetic powder-containing resin constituting the first magnetic portion.

2. The coil component according to claim 1, wherein the coil has a second coil portion subjected to insulation coating with a second flat coil pattern formed around the penetration hole on the other surface of the insulation substrate.

3. The coil component according to claim 1, wherein the second magnetic portion is present in the whole region of an inward region of the coil.

4. The coil component according to claim 1, wherein a smallest thickness in a thickness of the first magnetic portion, the smallest thickness is a distance from the outer surface of the magnetic body to the second magnetic portion, is longer than a length of a largest particle of the metal magnetic powders included in the metal magnetic powder-containing resin constituting the first magnetic portion.

5. The coil component according to claim 1, wherein the magnetic body has a pair of main surfaces facing each other in a thickness direction of the insulation substrate and a pair of end surfaces facing each other in a direction orthogonal to the thickness direction of the insulation substrate, and provided with the pair of external terminal electrodes respectively, and wherein a main surface-side thickness of the first magnetic portion which is a distance from the main surface of the magnetic body to the second magnetic portion is shorter than an end surface-side thickness of the first magnetic portion which is a distance from the end surface of the magnetic body to the second magnetic portion.

6. The coil component according to claim 1, wherein the second magnetic portion is constituted of a metal magnetic powder-containing resin containing metal magnetic powders including Fe.

* * * * *